US007232323B2

(12) United States Patent
Mohs et al.

(10) Patent No.: US 7,232,323 B2
(45) Date of Patent: Jun. 19, 2007

(54) ELECTRICAL ZERO INSERTION FORCE CONNECTOR

(75) Inventors: Wolfgang Mohs, Iserlohn (DE); Wilfried Heringhaus, Herne (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 11/511,822

(22) Filed: Aug. 29, 2006

(65) Prior Publication Data

US 2007/0049088 A1 Mar. 1, 2007

(30) Foreign Application Priority Data

Aug. 30, 2005 (DE) ..... 10 2005 040 952

(51) Int. Cl.
*H01R 13/15* (2006.01)

(52) U.S. Cl. ..... 439/265

(58) Field of Classification Search ..... 439/268, 439/263, 265, 259
See application file for complete search history.

(56) References Cited

U.S. PATENT DOCUMENTS

| | | | | |
|---|---|---|---|---|
| 4,613,193 A | | 9/1986 | Beers | |
| 5,573,415 A | * | 11/1996 | Fujitani et al. | 439/260 |
| 5,591,040 A | | 1/1997 | Dohan et al. | |
| 5,651,683 A | | 7/1997 | Shimamura et al. | |
| 5,795,171 A | * | 8/1998 | Bernardini | 439/260 |
| 5,915,986 A | * | 6/1999 | Maejima | 439/259 |
| 6,019,625 A | * | 2/2000 | Nimura et al. | 439/259 |
| 6,056,570 A | * | 5/2000 | Maejima | 439/259 |
| 6,083,023 A | | 7/2000 | Kamath | |
| 6,217,359 B1 | | 4/2001 | Norizuki et al. | |
| 6,244,885 B1 | * | 6/2001 | Iwahori | 439/263 |
| 6,368,129 B1 | * | 4/2002 | Wang et al. | 439/260 |
| 6,644,995 B1 | * | 11/2003 | Jones et al. | 439/260 |
| 6,676,428 B2 | * | 1/2004 | Burton | 439/270 |

FOREIGN PATENT DOCUMENTS

| | | |
|---|---|---|
| DE | 199 61 591 A1 | 6/2001 |
| DE | 10 2004 015 344 A1 | 10/2005 |
| EP | 0 896 397 A2 | 2/1999 |
| WO | WO 2005/096449 A1 | 10/2005 |

* cited by examiner

*Primary Examiner*—Ross Gushi
(74) *Attorney, Agent, or Firm*—Brooks Kushman P.C.

(57) ABSTRACT

An electrical zero insertion force connector includes a first part having two housings, a second part having a plug, and a sleeve contact having contact segments with a gap. A clamp movably connects to the sleeve contact. The second housing movably connects to the first housing. The sleeve contact extends into the first housing such that the clamp engages the first housing and the contact segments engage the second housing. The second part connects to the first housing such that the parts connect together with the plug inserted into the gap. Upon connecting to the first housing, the second part disengages the second housing from the first housing and moves the second housing toward the first housing such that the sleeve contact moves with the second housing away from the clamp until the clamp moves over the contact segments and presses the contact segments onto the plug.

20 Claims, 5 Drawing Sheets

ELECTRICAL ZERO INSERTION FORCE CONNECTOR

CROSS-REFERENCE TO RELATED APPLICATIONS

This application claims foreign priority benefits under 35 U.S.C. §119(a)-(d) to DE 10 2005 040 952.0, filed Aug. 30, 2005, which is hereby incorporated by reference in its entirety.

BACKGROUND OF THE INVENTION

1. Field of the Invention

The present invention relates to an electrical zero insertion force connector having first and second connector parts in which the first part includes a housing having a receptacle with a sleeve contact contained therein, the sleeve contact having contact segments and a clamping sleeve movable relative to the contact segments, and in which the second part has a plug pin which inserts into the contact segments to electrically connect the parts together upon the parts being mechanically connected together.

2. Background Art

Plug-and-socket connectors are used to electrically connect individual modules, flexible foils, printed circuit boards, etc., together. For example, plug-and-socket connectors are used in the automotive field to electrically connect control devices together or to electrically connect electronic modules integrated into a vehicle instrument panel to the vehicle electrical system.

A plug-and-socket connector generally includes two complementary connector parts which mechanically interconnect to form the connector. One part houses an electrically conductive sleeve contact and the other part includes an electrically conductive plug pin. The plug pin inserts into contact segments of the sleeve contact upon the parts being mechanically connected together such that the plug pin electrically connects to the sleeve contact thereby electrically connecting the parts. The contact segments have to exert a relatively high contact force onto the plug pin inserted therein to continuously ensure proper contacting between the plug pin and the sleeve contact even under highly variable environmental conditions. As such, considerable force is required for electrically connecting the parts together.

Some plug-and-socket connectors have joining aids such as levers which enable the connector parts to be electrically connected together without a sufficient expenditure of force. A plug-and-socket connector having a joining aid takes up relatively more space. This is a problem where space is at a premium or is relatively unaccessible. For instance, motor vehicle locations employing plug-and-socket connectors may not have space for accommodating joining aids.

Certain plug-and-socket connectors are known as "zero insertion force connectors" or "zero insertion force plugs" as the connector parts of these connectors may be electrically connected together without much or any force.

WO 2005/096449 discloses a generic zero insertion force connector having first and second connector parts. The first part houses a sleeve contact and the second part includes a pin-shaped counter-contact (i.e., a plug pin). The plug pin inserts into the contact segments of the sleeve contact without needing much force to do so upon the parts being mechanically connected together. During the end phase of the mechanical connection between the parts, an activation element (e.g., an adjustment clip) is activated to move relative to the sleeve contact and apply contact force to the contact segments to secure the plug pin therein. A problem is that the activation element can move, prior to the parts being mechanically connected together, in response to elements of the first part moving against one another and activating the activation element. The activation element is often in the activated position prior to the parts being mechanically connected together as the parts are sometimes exposed to mechanical influences prior to their mechanical connection. This results in higher assembly costs as the activation element has to be moved out of the activated position for the parts to be properly assembled together.

SUMMARY OF THE INVENTION

An object of the present invention is an electrical zero insertion force connector which does not have the above-noted problem.

An electrical zero insertion force connector in accordance with an embodiment of the present invention includes a first connector part having first and second housings, a second connector part having a plug, and a sleeve contact. The second housing movably connects to the first housing. The sleeve contact has a body and a clamping sleeve movably connected to the body. One end of the body includes adjacent contact segments. The sleeve contact extends into the first housing such that the clamping sleeve engages the first housing and the contact segments engage the second housing. The second connector part connects to the first housing such that the connector parts connect together with the plug inserted into a gap between the contact segments. Upon being connected to the first housing, the second connector part disengages the second housing from the first housing and moves the second housing towards the first housing such that the sleeve contact body moves with the second housing away from the clamping sleeve until the clamping sleeve moves over the contact segments and presses the contact segments onto the plug.

An electrical zero insertion force connector in accordance with an embodiment of the present invention includes a sleeve contact having a body and a clamp. One end of the body includes adjacent contact segments separated by a gap. The clamp movably connects to the body to move away from and over the contact segments. The connector further includes a first connector part having first and second housings. The first housing has inner and outer circumferentially extending side walls. The inner side wall forms a receiving area. The inner side wall has a catch and first and second recesses located at respective longitudinal positions. The second housing has a bottom wall and a circumferentially extending side wall having a projection. The second housing movably connects to the first housing between a first position in which the bottom wall is positioned away from the receiving area and a second position in which the bottom wall meets the receiving area such that the projection engages the first recess when the second housing is in the first position and engages the second recess when the second housing is the second position. The sleeve contact extends into the receiving area such that the clamp engages the catch and is locked in place relative to the body and the contact segments engage the bottom wall of the second housing. The connector further includes a second connector part having a plug. The second connector part connects to the first housing such that the connector parts are connected together with the plug being inserted into the gap of the contact segments. Upon being connected to the first housing, the second connector part disengages the projection from the first recess and moves the second housing from the first position to the second position in which the projection engages the second recess such that the sleeve contact body moves with the second housing away from the clamp until the clamp moves over the contact segments and presses the contact segments onto the plug.

An electrical zero insertion force connector in accordance with an embodiment of the present invention includes first and second connector parts and a sleeve contact. The sleeve contact has a body and a clamping sleeve. One end of the body includes adjacent contact segments separated by a gap. The clamping sleeve movably connects to the body to move away from and over the contact segments. The first connector part includes first and second housings. The first housing has a top wall and inner and outer side walls. The top wall and the inner side wall form a receiving area. The inner side wall has a first catch recess located at a lower position and a second catch recess located at an upper position. The inner side wall further has a catch. The sleeve contact extends through the top wall into the receiving area such that the clamping sleeve engages the catch on the inner side wall and is locked in place relative to the body. The second housing has a bottom wall and a side wall having a catch device. The second housing movably connects to the first housing between a pre-locked position in which the bottom wall is away from the receiving area and a final locked position in which the bottom wall meets the receiving area such that the catch device engages the first catch recess when the second housing is in the pre-locked position and engages the second catch recess when the second housing is the final locked position. Ends of the contact segments engage the bottom wall. The second connector part has a plug. The second connector part connects to the first housing such that the connector parts connect together with the plug being inserted into the gap of the contact segments. Upon being connected to the first housing, the second connector part disengages the catch device from the first catch recess and moves the second housing from the pre-locked position to the final locked position in which the catch device engages the second catch recess such that the body moves with the second housing away from the clamping sleeve until the clamping sleeve moves over the contact segments and presses the contact segments onto the plug.

The electrical zero insertion force connector in accordance with embodiments of the present invention does not have the above-noted problem referred to in the above-mentioned object as the second (fixed) housing is movably connected to the first (enclosed) housing in either a pre-locked position or a final locked position, the second connector part when connected to the first housing disengages the locking device of the second housing from the first housing and moves the second housing from the pre-locked position to the final locked position while at the same time the movement of the second housing causes the clamping sleeve to move along the sleeve contact body until the clamping sleeve is positioned over the contact segments to thereby press the contact segments onto the plug of the second connector part.

A feature of the electrical zero insertion force connector in accordance with embodiments of the present invention lies in first connecting the contact sleeve body and the clamping sleeve of the sleeve contact to the two housing parts of the first connector part which are held stationary until the second connector part is connected to the first connector part such that the position of the clamping sleeve relative to the contact sleeve body is unambiguously specified by the two housing parts.

In joining the housing parts to the second connector part, first the plug is inserted without force into the contact segments of the contact sleeve. Further motion of the plug detaches the connection between the two housing parts and causes the housing parts to move relative to one another, and at the same time the clamping sleeve moves relative to the contact sleeve body into the activation position. It is advantageous as the sleeve contact is activated by being joined to the counter-contact (i.e., the plug).

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
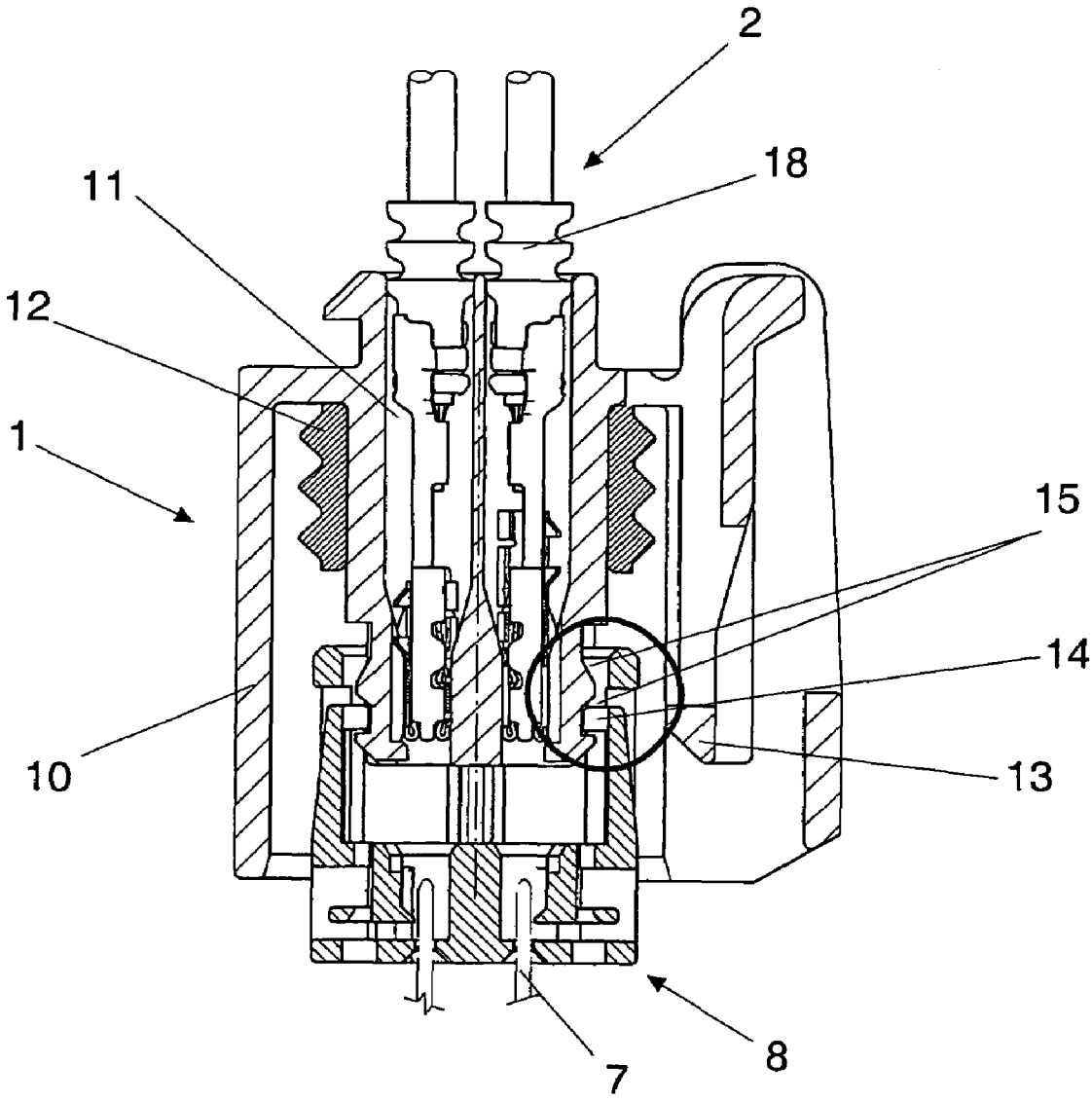
FIGS. 1, 2, and 3 respectively illustrate sectional views of a first plug-and-socket connector part of an electrical zero force insertion connector in various joined stages in accordance with an embodiment of the present invention.
Figure 2:
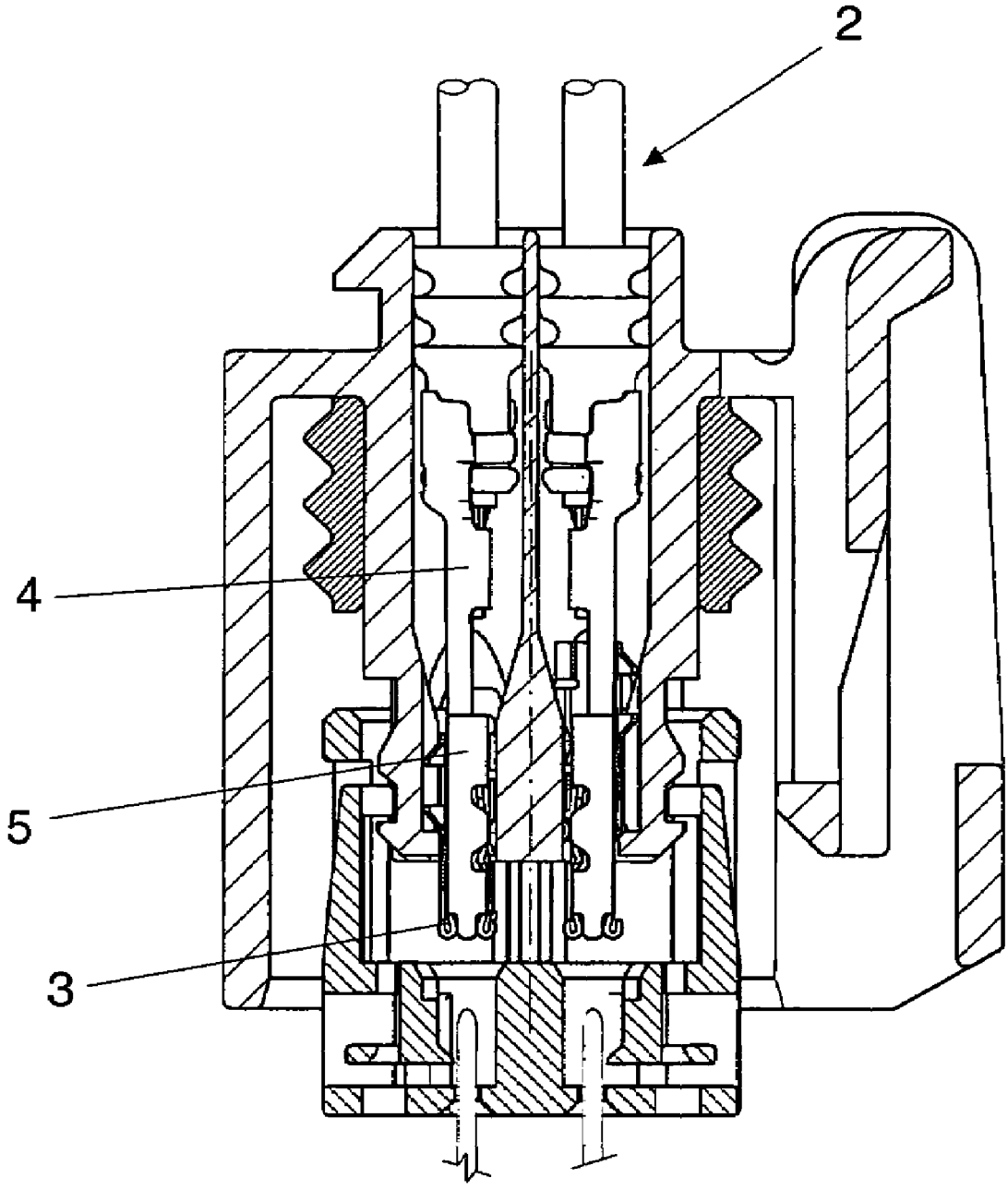
Figure 3:
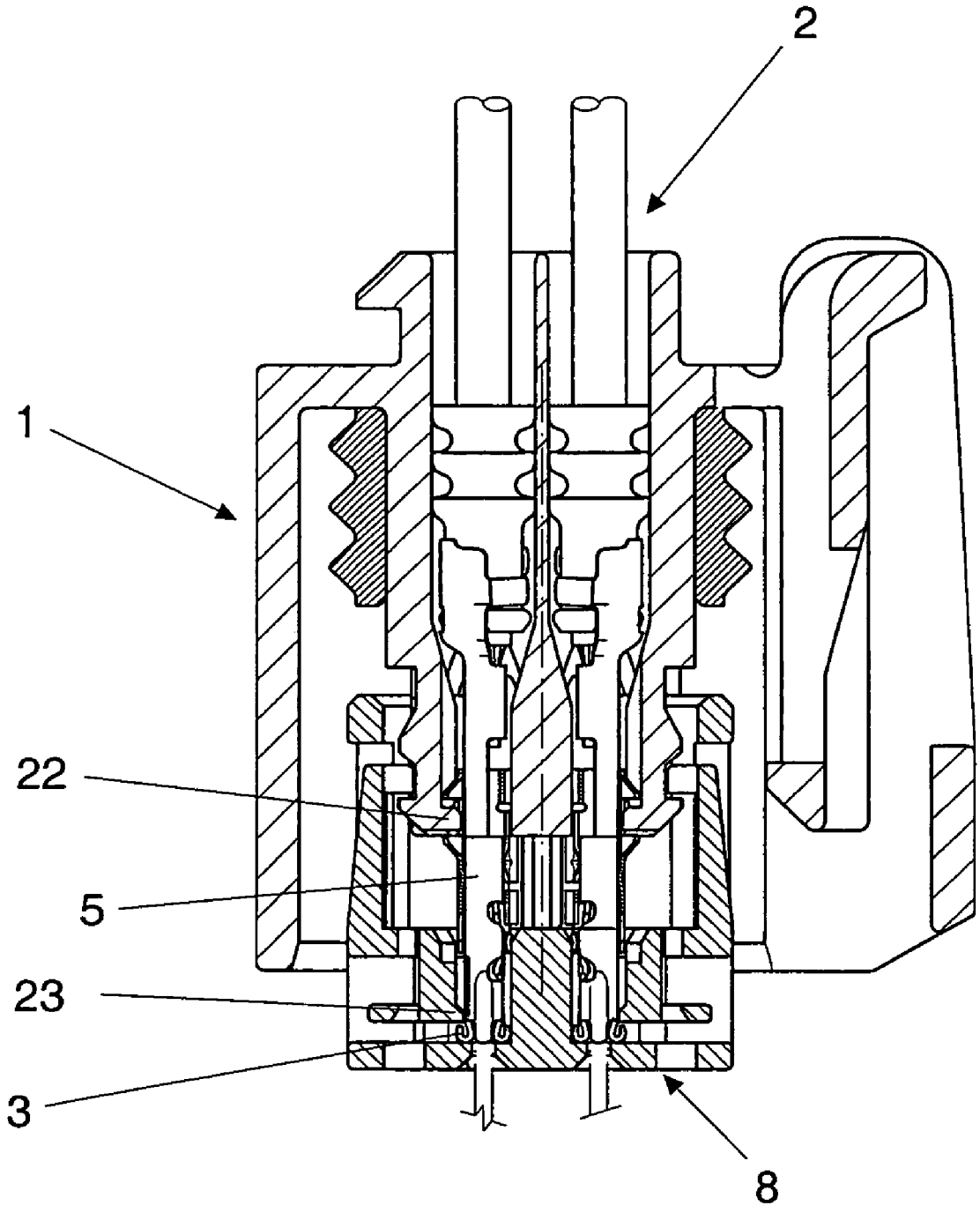
Figure 4:
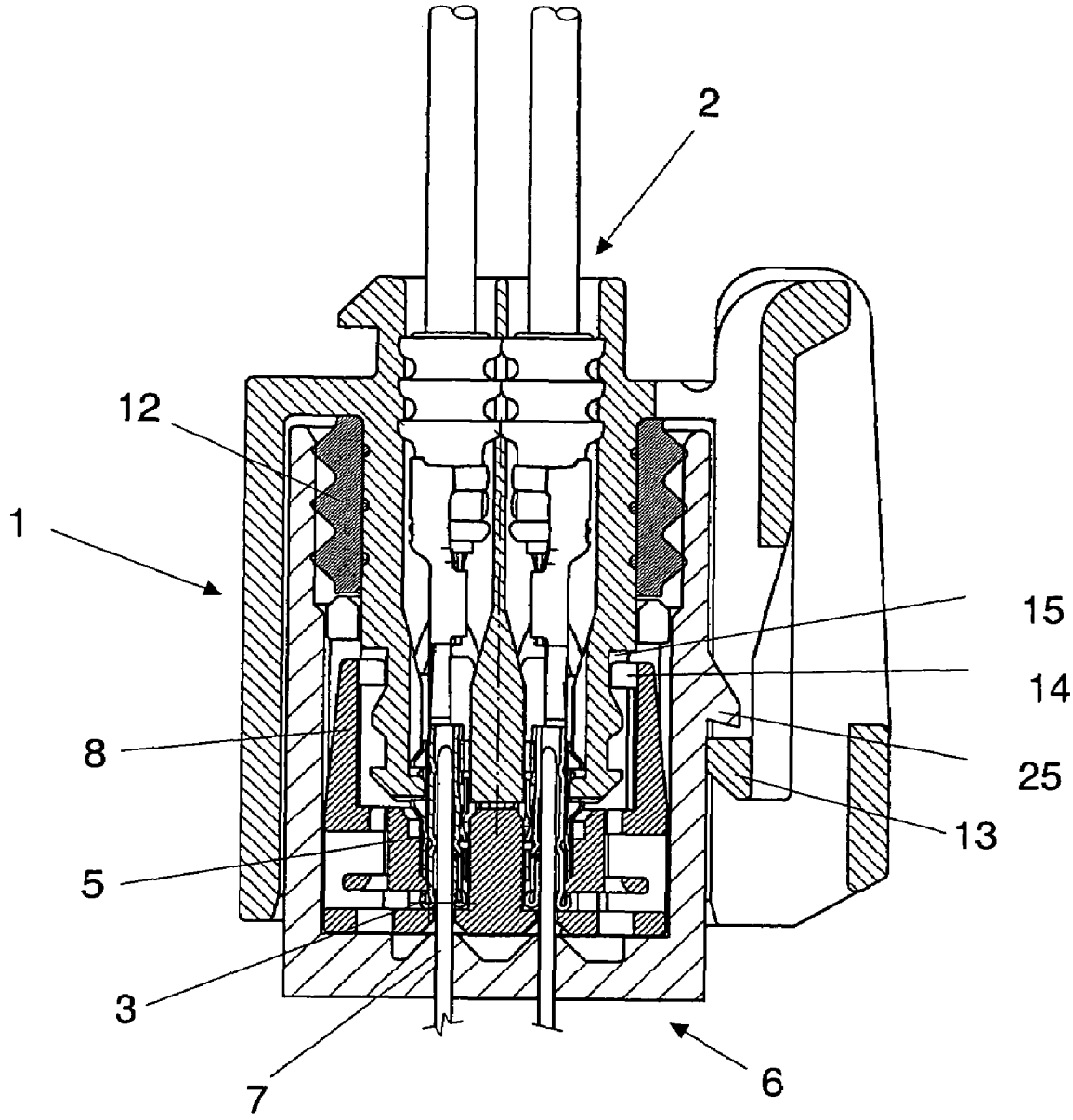
FIG. 4 illustrates a sectional view of the first plug-and-socket connector part and a second plug-and-socket connector part of the electrical zero force insertion connector connected together in accordance with an embodiment of the present invention.

FIGS. 1, 2, and 3 illustrate respective sectional views of a first plug-and-socket connector part of an electrical zero force insertion connector in various joined stages. FIG. 4 illustrates a sectional view of the first connector part and a second connector part 6 mechanically and electrically interconnected to form the electrical zero force insertion connector.

The first connector part includes a first housing 1 and a second housing 8. First housing 1 and second housing 8 are independent housing parts which connect together to form the first connector part. Second housing 8 assumes either a pre-locked position or a final locked position relative to first housing 1 when the first and second housings are connected. That is, second housing 8 is movably connected to first housing 1 between the pre-locked position and the final locked position. FIGS. 1, 2, and 3 illustrate second housing 8 in the pre-locked position. FIG. 4 illustrates second housing 8 in the final locked position.

First housing 1 has a circumferentially extending outer side wall 10, a circumferentially extending inner side wall, and a top end wall. The top end wall and the inner side wall form a receiving area 11 of first housing 1 with the underside of the receiving area being opened. The underside of first housing 1 is also opened. Receiving area 11 includes contact receptacles. A plurality of sleeve contacts 2 respectively extend through passages of the top end wall into respective ones of the receptacles in receiving area 11. The passages and the receptacles are respectively aligned with one another and arranged in a given configuration such as one row of two columns. Thus, two sleeve contacts 2 may be inserted into and received by receiving area 11 as shown in FIGS. 1, 2, 3, 4, 6*a*, and 6*b*. First housing 1 may have additional contact receptacles and additional sleeve contacts in other sectional levels than the sectional level illustrated.

A seal 12 extending around the inner side wall of first housing 1 encloses receiving area 11. Seal 12 seals off receiving area 11 with respect to a second connector part 6 (shown in FIGS. 4, 6*a*, and 6*b*) which is complementary to the first connector part. The first connector part and second connector part 6 (referred to herein as a "unit connection") mechanically and electrically connect together to form the electrical zero force insertion connector (shown in FIGS. 4, 6*a*, and 6*b*).

A one-piece catch hook 13 is integrally molded to an inner surface portion of outer side wall 10 of first housing 1. Catch hook 13 is used to produce a secondary lock between the first connector part and second connector part 6 when the two connector parts are mechanically connected together.

The outer surface of the inner side wall of first housing 1 includes a pair of catch recesses 15 (the circle inscribed in FIG. 1 is provided for emphasis). Catch recesses 15 are located at different (upper and lower) longitudinal positions along the inner side wall of first housing 1.

Second housing 8 includes a bottom end portion and a circumferentially extending side wall. Second housing 8 is connected as an independent housing part to the inner side wall of first housing 1 and extends through the underside of first housing 1 to meet with receiving area 11. The side wall of second housing 8 meets with the outer surface of the inner side wall of first housing 1 and the bottom end portion of the second housing meets with the underside of receiving area 11 when the second housing is connected to the first housing. The side wall of second housing 8 includes an inwardly pointing catch element 14. Catch element 14 inserts into one of the two catch recesses 15 on the outer surface of the inner side wall of first housing 1 in order to connect second housing 8 to the first housing.

In FIGS. 1, 2, and 3, catch element 14 is inserted into the lower catch recess 15 such that second housing 8 is in the pre-locked position with respect to first housing 1. In the pre-locked position, second housing 8 is connected to but positioned away from first housing 1 such that the bottom end portion of the second housing is separated from the underside of receiving area 11 of the first housing. In FIG. 4, catch element 14 is inserted into the upper catch recess 15 such that second housing 8 is in the final locked position with respect to first housing 1. In the final locked position, second housing 8 is connected to and positioned closer to first housing 1 such that the bottom end portion of the second housing meets with and encloses the underside of receiving area 11 of the first housing.

Figure 5:
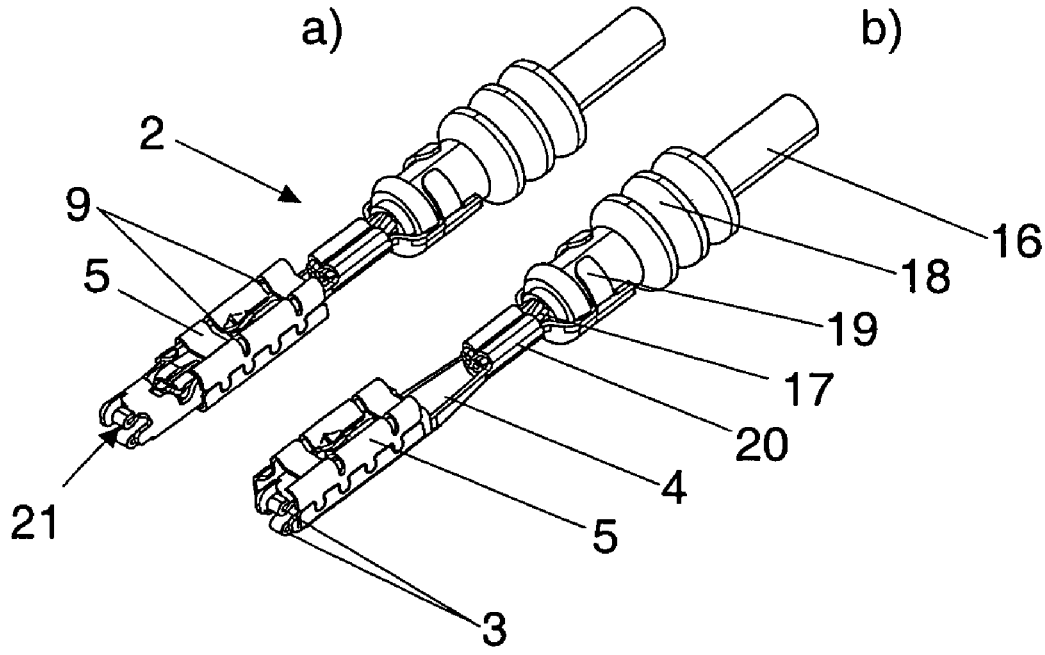
FIG. 5*a* illustrates a sleeve contact having contact segments and a clamping sleeve in which the clamping sleeve is positioned away from the contact segments such that the contact segments are in an opened position in accordance with an embodiment of the present invention.
FIG. 5*b* illustrates a sleeve contact having contact segments and a clamping sleeve in which the clamping sleeve is positioned over the contact segments such that the contact segments are in a closed or constricted position in accordance with an embodiment of the present invention.

Referring now to FIGS. 5*a* and 5*b*, two views of an electrically conductive sleeve contact 2 are shown. As will be described, FIG. 5*a* illustrates sleeve contact 2 in an opened position and FIG. 5*b* illustrates sleeve contact 2 in a constricted or closed position. Sleeve contact 2 includes a molded metal base body 4 which is connected to an electrical line 16. Electrical line 16 includes a metallic conductor 17. A crimp connection 20 electrically and mechanically connects metallic conductor 17 to one end of base body 4. A rubber seal 18 surrounds electrical line 16. Two bending clips 19 attach seal 18 to base body 4 in the transition region of electrical line 16.

The other end of base body 4 away from crimp connection 20 includes a free end section having two adjacent contact segments 3. Contact segments 3 are integrally molded as one piece to the other end of base body 4. Contact segments 3 form a gap 21 therebetween. Gap 21 receives a flat, electrically conductive plug pin (not shown in FIG. 5*a* or 5*b*) inserted therein. Contact segments 3 are to apply a contact force to hold the plug pin in gap 21 after the plug pin has been inserted into the gap. In accordance with the present invention, contact segments 3 do not apply such contact force while the plug pin is being inserted into gap 21, but then subsequently apply such contact force after the plug pin has been inserted into the gap.

The ends of contact segments 3 are advantageously bent outward for three reasons. First, edges which could interfere with insertion of a plug pin into gap 21 are avoided in the region of the gap. Second, for the same reasoning, the rounded ends of contact segments 3 simplify insertion of sleeve contacts 2 into the passages of first housing 1 for insertion into receiving area 11 of the first housing. Third, the bent ends of contact segments 3 form catch hooks which are suitable for connecting sleeve contacts to first housing 1.

Sleeve contact 2 includes a clamping sleeve 5. Clamping sleeve 5 is elastically attached to base body 4 and partially encloses the cross-section of the base body. Clamping sleeve 5 includes a plurality of transversely oriented slotted openings 9. Slotted openings 9 create a flat spring characteristic curve. Clamping sleeve 5 is arranged to be longitudinally movable along base body 4. As such, clamping sleeve 5 can be positioned along base body 4 in an upper position away from contact segments 3 as shown in FIG. 5*a*. Likewise, clamping sleeve 5 can be positioned along base body 4 in a lower position over contact segments 3 as shown in FIG. 5*b*.

When clamping sleeve 5 is positioned away from contact segments 3 as shown in FIG. 5*a*, the clamping sleeve does not exert pressure or contact forces onto the contact segments. As such, contact segments 3 are in an opened position and a plug pin is allowed to be inserted without force into gap 21 between the contact segments. When clamping sleeve 5 is positioned over contact segments 3 as shown in FIG. 5*b*, the clamping sleeve applies pressure or contact forces to the contact segments and presses the contact segments together such that gap 21 between the contact segments is constricted or relatively closed. As such, a plug pin inserted into gap 21 is snugly retained therein as a result of contact segments 3 being constricted by pressure from clamping sleeve 5.

FIG. 1 illustrates the initial insertion phase of sleeve contacts 2 into receiving area 11 of first housing 1. As sleeve contacts 2 are inserted through passages on the top end wall of first housing 1 and into corresponding receptacles in receiving area 11, seals 18 of the contact sleeves seal off the passages against outside influences and thereby seal off the receiving area from outside influences entering through the top end wall of the first housing.

As shown in FIG. 3, during the insertion of each sleeve contact 2 into receiving area 11, clamping sleeve 5 of the sleeve contact engages and locks with a corresponding catch 22 of first housing 1 to fix the sleeve contact in place relative to the first housing. Catches 22 are integrally molded on the inner side wall of first housing 1 and point inward to engage with clamping sleeves 5 of sleeve contacts 2.

During the assembly phase of sleeve contacts 2 into receiving area 11, a clamping sleeve 5 of a sleeve contact may be in the lower position (shown in FIG. 5*b*) in which the clamping sleeve is positioned over contact segments 3 of the sleeve contact and the contact segments are constricted or closed. In this case, further insertion of sleeve contact 2 into receiving area 11 causes base body 4 of the sleeve contact to move relative to clamping sleeve 5 (as indicated in FIG. 2) until the clamping sleeve moves to the upper position (shown in FIG. 5*a*) away from contact segments 3 and releases the contact segments.

When the final insertion position shown in FIG. 3 is reached, the bent ends of contact segments 3 of a contact sleeve 2 engage and lock with a corresponding projection 23 of second housing 8. As a result, sleeve contacts 2 are connected to first housing 1 by way of the interconnection of clamping sleeves 5 and catches 22 of the first housing, and are connected to second housing 8 by way of the interconnection of the ends of contact segments 3 and projections 23 of the second housing. Consequently, sleeve contacts 2 are protected from being pulled out from the first connector part, which is made up of interconnected first housing 1 and second housing 8. Additionally, the locking connection between clamping sleeve 5 and first housing 1 and the locking connection between the ends of contact segments 3 and second housing 8 ensures that as a result of first and second housings, which in this joining phase are still connected so as to prevent relative motion relative to one another, the contact segments are held in the open position (shown in FIG. 5*a*). Consequently, plug pins 7 are allowed to be inserted into respective gaps 21 of the contact segments without force.

Plugs pins 7 are part of second connector part 6. Second connector part 6 includes a housing having a bottom end wall and a circumferentially extending side wall. The walls of second connector part 6 form an interior in which receiving area 11 of first housing 1 and second housing 8 are contained within upon the second connector part being connected to the first connector part. The bottom end wall of second connector part 6 includes passages. Plug pins 7 are inserted through the passages of the bottom end wall of second connector part 6 to extend into receiving area 11 of first housing 1.

Generally, second connector part 6 is connected to the first connector part (made up of interconnected first housing 1 and second housing 8) to form the electrical zero force insertion connector (as shown in FIG. 4) after sleeve contacts 2 have been inserted into receiving area 11 of the first connector part and connected to the first connector part. The act of connecting second connector part 6 to the first connector part mechanically connects the first and second connector parts together. As the first and second connector parts are being mechanically connected together, plug pins 7 insert into respective gaps 21 of contact segments 3 of contact sleeves 2 to thereby electrically connect the first and second connector parts.

Figure 6:
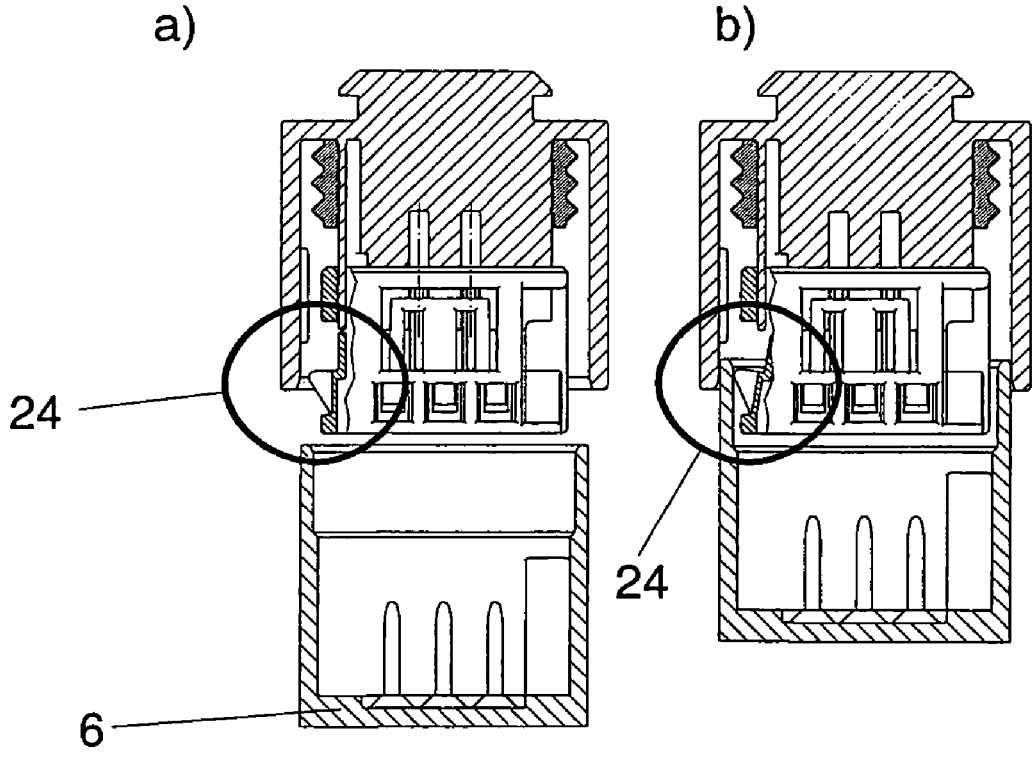
FIG. 6*a* illustrates a sectional view of the first and second plug-and-socket connector parts of the electrical zero force insertion connector prior to the connector parts being connected together in accordance with an embodiment of the present invention.
FIG. 6*b* illustrates a sectional view of the first and second plug-and-socket connector parts of the electrical zero force insertion connector as the connector parts begin to connect together in accordance with an embodiment of the present invention.

As shown in FIGS. 6*a* and 6*b*, as second connector part 6 is being mechanically connected to the first connector part, the second connector part opens a lock 24. Lock 24 specifies the position of second housing 8 relative to first housing 1 so that when second connector part 6 is moved toward the first housing the second connector part carries the second housing, which has now become freely movable, along with it towards the first housing.

The motion of second housing 8 toward first housing 1 causes base body 4 of each sleeve contact 2 to be moved upward away from the clamping sleeves 5 (which are connected in a locked manner to catches 22 of first housing 1) whereupon the clamping sleeves apply contact force and press contact segments 3 of sleeve contacts 2 onto the inserted plug pins 7.

The contact force for secure contacting between sleeve contacts 2 and plug pins 7 thus arises from the mechanical joining force of second connector part 6 to the first connector part after the plug pins have been inserted into gaps 21 of contact segments 3 of the sleeve contacts. In this manner, lock 24, which may release upon insertion of second connector part 6 into the first connector part, ensures that contact segments 3 of sleeve contacts 2 are held open until the second connector part is mechanically connected to the first connector part.

FIG. 4 illustrates the completely assembled electrical zero force insertion connector which includes the first connector part and second connector part 6 interconnected together. The side wall of second connector part 6 is inserted between outer side wall 10 and the inner side wall of first housing 1 and between the outer side wall of the first housing and the side wall of second housing 8. An end portion of the side wall of second connector part 6 meets the inner surface of the top end wall of first housing 1 and this end portion of the side wall of the second connector part is sandwiched between the inner surface of outer side wall 10 of the first housing and seal 12. The bottom end portion of second housing 8 meets with the underside of receiving area 11. Seal 12 thereby protects the interior of the electrical zero force insertion connector from harmful environmental influences, especially moisture.

Catch hook 13 on outer side wall 10 of first housing 1 locks with edge 25 on the side wall of second connector part 6 thereby connecting the first connector part and the second connector part together in a positive-fit manner. Catch element 14 of second housing 8 now engages with the upper catch recess 15 of first housing 1 such that the second housing reaches its final locked position with respect to the first housing. Additionally, clamping sleeves 5 of sleeve contacts 2 now enclose the respective contact segments 3 and thus apply the contact force required for secure contacting of plug pins 7 inserted within gaps 21 of the contact segments.

LIST OF REFERENCE NUMBERS

1 First (enclosed) housing
2 Sleeve contacts
3 Contact segments
4 Base body
5 Clamping sleeve
6 Second housing (unit connection)
7 Plug pins
8 Second (fixed) housing
9 Slotted openings
10 Outer wall
11 Receiving area
12 Seal
13 Catch hook
14 Catch elements
15 Catch recesses
16 Electrical line
17 Conductor
18 Rubber seal
19 Bending clips

20 Crimp connection
21 Gap
22 Catch
23 Projection
24 Lock
25 Edge While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electrical zero insertion force connector comprising:

a first connector part having first and second housings, wherein the second housing movably connects to the first housing;

a second connector part having a plug; and a sleeve contact having a body and a clamping sleeve movably connected to the body, wherein one end of the body includes adjacent contact segments, wherein the sleeve contact extends into the first housing such that the clamping sleeve engages the first housing and the contact segments engage the second housing;

wherein the second connector part connects to the first housing such that the connector parts connect together with the plug inserted into a gap between the contact segments;

wherein upon being connected to the first housing, the second connector part disengages the second housing from the first housing and moves the second housing towards the first housing such that the sleeve contact body moves with the second housing away from the clamping sleeve until the clamping sleeve moves over the contact segments and presses the contact segments onto the plug.

2. The connector of claim 1 wherein:

the first housing includes a catch, wherein the clamping sleeve engages the catch to engage the first housing and be locked in place relative to the sleeve contact body.

3. The connector of claim 1 wherein:

the first housing includes first and second recesses located at respective positions and the second housing includes a projection;

wherein the projection of the second housing engages the first recess of the first housing to connect the second housing to the first housing;

wherein upon being connected to the first housing, the second connector part disengages the projection of the second housing from the first recess of the first housing and moves the second housing towards the first housing until the projection of the second housing engages the second recess of the first housing.

4. The connector of claim 1 wherein:

the contact segments are rounded.

5. The connector of claim 1 wherein:

the contact segments are bent.

6. The connector of claim 1 wherein:

the contact segments include catch hooks for engaging the second housing.

7. The connector of claim 1 wherein:

the clamping sleeve is elastic.

8. The connector of claim 1 wherein:

the clamping sleeve includes slotted openings running transversely to the sleeve contact body.

9. An electrical zero insertion force connector comprising:

a sleeve contact having a body and a clamp, one end of the body includes adjacent contact segments separated by a gap, the clamp is movably connected to the body to move away from and over the contact segments;

a first connector part having first and second housings;

the first housing having inner and outer circumferentially extending side walls, the inner side wall forming a receiving area, the inner side wall having a catch and first and second recesses located at respective longitudinal positions;

the second housing having a bottom wall and a circumferentially extending side wall having a projection, the second housing is movably connected to the first housing between a first position in which the bottom wall is positioned away from the receiving area and a second position in which the bottom wall meets the receiving area such that the projection engages the first recess when the second housing is in the first position and engages the second recess when the second housing is the second position;

wherein the sleeve contact extends into the receiving area such that the clamp engages the catch and is locked in place relative to the body and the contact segments engage the bottom wall of the second housing;

a second connector part having a plug, the second connector part connects to the first housing such that the connector parts are connected together with the plug being inserted into the gap of the contact segments, wherein upon being connected to the first housing the second connector part disengages the projection from the first recess and moves the second housing from the first position to the second position in which the projection engages the second recess such that the sleeve contact body moves with the second housing away from the clamp until the clamp moves over the contact segments and presses the contact segments onto the plug.

10. The connector of claim 9 further comprising:

a seal circumferentially surrounding the outer surface of the inner side wall of the first housing.

11. The connector of claim 10 wherein:

the second connector part includes a bottom wall and a circumferentially extending side wall, wherein the side wall of the second connector part is sandwiched between the seal and the inner surface of the outer wall of the first housing upon the second connector part being connected to the first housing.

12. The connector of claim 11 wherein:

the outer surface of the side wall of the second connector part includes an protruding edge and the inner surface of the outer side wall of the first housing includes a catch hook, wherein the protruding edge engages the catch hook to lock the connection between the second connector part and the first housing.

13. The connector of claim 9 wherein:

the clamp includes slotted openings running transversely to the sleeve contact body.

14. The connector of claim 9 wherein:

the clamping sleeve is elastic.

15. An electrical zero insertion force connector comprising:

a sleeve contact having a body and a clamping sleeve, one end of the body includes adjacent contact segments separated by a gap, the clamping sleeve is movably connected to the body to move away from and over the contact segments;

a first connector part having first and second housings;

the first housing having a top wall and inner and outer side walls, the top wall and the inner side wall forming a receiving area, the inner side wall having a first catch recess located at a lower position and a second catch recess located at an upper position, the inner side wall further having a catch, wherein the sleeve contact extends through the top wall into the receiving area such that the clamping sleeve engages the catch on the inner side wall and is locked in place relative to the sleeve contact body;

the second housing having a bottom wall and a side wall having a catch device, the second housing is movably connected to the first housing between a pre-locked position in which the bottom wall is positioned away from the receiving area and a final locked position in which the bottom wall meets the receiving area such that the catch device engages the first catch recess when the second housing is in the pre-locked position and engages the second catch recess when the second housing is the final locked position, wherein ends of the contact segments of the contact sleeve engage the bottom wall;

a second connector part having a plug, the second connector part connects to the first housing such that the first and second connector parts are connected together with the plug being inserted into the gap of the contact segments of the contact sleeve, wherein upon being connected to the first housing the second connector part disengages the catch device from the first catch recess and moves the second housing from the pre-locked position to the final locked position in which the catch device engages the second catch recess such that the body of the sleeve contact moves with the second housing away from the clamping sleeve of the sleeve contact until the clamping sleeve moves over the contact segments and presses the contact segments onto the plug.

16. The connector of claim 15 wherein:

the ends of the contact segments are rounded.

17. The connector of claim 15 wherein:

the ends of the contact segments are bent.

18. The connector of claim 15 wherein:

the ends of the contact segments include catch hooks for engaging the bottom wall of the second housing.

19. The connector of claim 15 wherein:

the clamping sleeve is elastic.

20. The connector of claim 15 wherein:

the clamping sleeve includes slotted openings running transversely to the sleeve contact body.

* * * * *